US007786946B2

(12) United States Patent
Diaz et al.

(10) Patent No.: US 7,786,946 B2
(45) Date of Patent: Aug. 31, 2010

(54) HOLLOW DIELECTRIC PIPE POLYROD ANTENNA

(75) Inventors: Rodolfo E. Diaz, Phoenix, AZ (US); Mingyue Shen, San Diego, CA (US); Jeffrey W. Peebles, Phoenix, AZ (US)

(73) Assignee: Arizona Board of Regents for and on behalf of Arizona State University, Scottsdale, AZ (US)

( * ) Notice: Subject to any disclaimer, the term of this patent is extended or adjusted under 35 U.S.C. 154(b) by 291 days.

(21) Appl. No.: 12/004,729

(22) Filed: Dec. 21, 2007
(Under 37 CFR 1.47)

(65) Prior Publication Data

US 2009/0160721 A1 Jun. 25, 2009

Related U.S. Application Data

(60) Provisional application No. 60/871,536, filed on Dec. 22, 2006.

(51) Int. Cl.
*H01Q 13/00* (2006.01)

(52) U.S. Cl. ..... 343/785; 343/771; 333/21 R

(58) Field of Classification Search ..... 343/785, 343/771, 772; 333/21 R, 239
See application file for complete search history.

(56) References Cited

U.S. PATENT DOCUMENTS 3,216,017 A * 11/1965 Moore ..... 343/756
3,389,394 A * 6/1968 Lewis ..... 343/725
3,518,691 A * 6/1970 Hallendorff ..... 343/785
4,468,672 A * 8/1984 Dragone ..... 343/783
4,673,945 A * 6/1987 Syrigos ..... 343/755
4,673,947 A * 6/1987 Newham ..... 343/781 CA
5,248,987 A * 9/1993 Lee ..... 343/785
5,406,298 A 4/1995 Walters
5,936,589 A 8/1999 Kawahata

OTHER PUBLICATIONS

"Double-Ridge to Rectangular Waveguide Transitions R-30 Series," Microwave Engineering Corporation (MEC) http://www.microwaveeng.com/catalog/t8f.pdf [2 pages, accessed Nov. 13, 2008].

"Double-Ridge Waveguide-To-Coaxial Adapters R-40 Series," Microwave Engineering Corporation (MEC) http://www.microwaveeng.com/catalog/t7e.pdf [1 page, accessed Nov. 13, 2008].

(Continued)

*Primary Examiner*—Tho G Phan
(74) *Attorney, Agent, or Firm*—Fish & Richardson P.C.

(57) ABSTRACT

A waveguide including: a first section including a first surface, a second surface, an upper wall, and a lower wall facing the upper wall; and a second section extending from the second surface; wherein the first section includes an upper ridge on the upper wall of the first section and a lower ridge on the lower wall of the first section, wherein the second section includes an upper conductor extending from a top portion of the second surface and a lower conductor extending from a lower portion of the second surface with a gap between the upper and lower conductors, wherein the upper conductor is electrically connected to the upper ridge, wherein the lower conductor is electrically connected to the lower ridge, and wherein the upper and lower conductors are adapted to propagate a wave and reduce discontinuity of the wave a connection between the first and second sections.

15 Claims, 8 Drawing Sheets

OTHER PUBLICATIONS

Shen, M., "Design of a hollow dielectric pipe antenna for a free-space material measurement test set-up" Arizona State University, May 2006 thesis for Masters of Science [Abstract only], 1 page.

Spitz, E., "A new class of new type of broad-band antennas," Electromagnetic Theory and Antennas, Edited by E.C. Jordan, Pergamon Press, New York, 1963, pp. 1139-1148.

* cited by examiner

HOLLOW DIELECTRIC PIPE POLYROD ANTENNA

CROSS-REFERENCE TO RELATED APPLICATION

This application claims priority to and the benefit of U.S. Provisional Application No. 60/871,536, filed Dec. 22, 2006, the entire contents of which are expressly incorporated herein by reference.

FIELD

Broadband antennas or systems incorporating the same are generally discussed herein, with particular discussions extended to a compact broadband antenna with a polyrod.

BACKGROUND

A simple, reliable, broadband method for extracting constitutive property measurements from an electromagnetic material sample occurs under plane wave conditions. Therefore, the ability to mimic a plane wave condition at the material sample is of paramount importance. Performing such measurements in a small spot-size and a broad band of frequencies allows designers and users of electromagnetic materials to reliably determine the constitutive properties of material samples as a function of position, particularly graded impedance and resistance sheets (such as those used to reduce diffraction from edges of parabolic dish antennas).

SUMMARY OF THE INVENTION

An aspect of an embodiment of the present invention is directed toward an antenna capable of providing a relatively small spot-size in a plane wave condition.

An embodiment of the present invention provides a waveguide including: a first section including a first surface facing a flange, a second surface oppositely facing away from the first surface, an upper wall, and a lower wall facing the upper wall; and a second section extending out from the second surface; wherein the first section includes an upper ridge disposed on the upper wall of the first section and a lower ridge disposed on the lower wall of the first section, wherein the second section includes an upper conductor extending out from a top portion of the second surface and a lower conductor extending out from a lower portion of the second surface with a gap between the upper conductor and the lower conductor, wherein the upper conductor is electrically connected to the upper ridge, wherein the lower conductor is electrically connected to the lower ridge, and wherein the upper conductor and the lower conductor are adapted to propagate a wave from the first section and to reduce a discontinuity of the wave propagated at a connection between the first section and the second section.

The upper conductor may include an upper notch at a distal end away from the second surface, wherein the lower conductor may include a lower notch at a distal end away from the second surface, and wherein the upper and lower notches are configured to reduce reflection of the wave propagated by the upper conductor and the lower conductor.

The second section may consist essentially of the upper conductor extending out from the top portion of the second surface and the lower conductor extending out from the lower portion of the second surface with the gap between the upper conductor and the lower conductor.

An embodiment of the present invention provides a waveguide including: a double-ridged waveguide section having a first ridge and a second ridge; a first conductor extending from the first ridge; and a second conductor extending from the second ridge; wherein the first and second conductors are configured to propagate a wave from the double-ridged waveguide section and to reduce a discontinuity of the wave propagated at a connection between the double-ridged waveguide section and the two conductors.

The first conductor may include an upper notch at a distal end away from the double-ridged waveguide section, wherein the second conductor may include a lower notch at a distal end away from the double-ridged waveguide section, and wherein the upper and lower notches are configured to reduce reflection of the wave propagated by the upper conductor and the lower conductor.

An embodiment of the present invention provides a dielectric pipe antenna including: a dielectric pipe; and a waveguide for receiving one end of the dielectric pipe; wherein the waveguide includes: a first section including a first surface facing a flange, a second surface oppositely facing away from the first surface, an upper wall, and a lower wall facing the upper wall; and a second section extending out from the second surface; wherein the first section includes an upper ridge disposed on the upper wall of the first section and a lower ridge disposed on the lower wall of the first section, wherein the second section includes an upper conductor extending out from a top portion of the second surface and a lower conductor extending out from a lower portion of the second surface with a gap between the upper conductor and the lower conductor, and wherein the dielectric pipe includes: a hollow tubular dielectric sleeve portion having an external sleeve diameter and an internal sleeve diameter; and a tapered dielectric pipe portion having an internal pipe diameter, a first outer pipe diameter at a first location of the tapered dielectric pipe portion, and a second outer pipe diameter at a second location of the tapered dielectric pipe portion, wherein the first outer pipe diameter is larger than the second outer pipe diameter, and wherein the first location is between the hollow tubular dielectric sleeve portion and the second location.

The dielectric pipe may have a dielectric constant ranging from about 1.5 to about 9.

The dielectric pipe may have a dielectric constant ranging from about 2.5 to about 3.

The hollow tubular dielectric sleeve portion may surround and be electromagnetically coupled to the upper conductor and the lower conductor of the second section.

A wave generated within the dielectric pipe may be substantially planar, and wherein a generated wave upon exiting the dielectric pipe may be substantially the same as the wave generated within the dielectric pipe surrounding the upper conductor and the lower conductor.

The second section may consist essentially of the upper conductor extending out from the top portion of the second surface and the lower conductor extending out from the lower portion of the second surface with the gap between the upper conductor and the lower conductor.

Each of the upper conductor and the lower conductor of the second section may have a length configured to maximize an electromagnetic coupling of the upper conductor and the lower conductor to the dielectric pipe surrounding the upper conductor and the lower conductor.

The upper conductor may include an upper notch at a distal end away from the second surface, wherein the lower conductor may include a lower notch at a distal end away from the second surface, and wherein the upper and lower notches may be configured to reduce reflection of the wave propagated by the upper conductor and the lower conductor.

A height of the first metallic section of the waveguide may be about 0.473 inches, a width of the first metallic section of the waveguide may be about 0.833 inches, and each of the upper conductor and the lower conductor may have a length of about 1.476 inches, and wherein the height of the first metallic section, the width of the first metallic section, and the length of each of the upper conductor and the lower conductor may be configured to operate at frequency ranging from about 5.5 GHz to about 18 GHz.

A length of the hollow tubular dielectric sleeve may be at about 2.952 inches, the internal sleeve diameter may be about 0.886 inches and a length of the tapered dielectric pipe portion may be at about 1.969 in, and wherein the length of the hollow tubular dielectric sleeve, the internal sleeve diameter, and the length of the tapered dielectric pipe portion may be configured to operate at a frequency range of about 5.5 GHz to about 18 GHz.

A length of the hollow tubular dielectric sleeve, the internal sleeve diameter, a length of the tapered dielectric pipe portion and proportions of the double-ridged waveguide may be configured to operate at a frequency range of about 100 MHz to about 100 GHz.

The one end of the dielectric pipe may make a releasable-fit engagement with the second metallic section of the waveguide.

An embodiment of the present invention provides a dielectric pipe antenna including: a dielectric pipe; and a waveguide for receiving one end of the dielectric pipe; wherein the waveguide includes: a double-ridged waveguide section having a first ridge and a second ridge; a first conductor extending from the first ridge; and a second conductor extending from the second ridge; wherein the dielectric pipe includes: a hollow tubular dielectric sleeve portion having an external sleeve diameter and an internal sleeve diameter; and a tapered dielectric pipe portion having an internal pipe diameter, a first outer pipe diameter at a first location of the tapered dielectric pipe portion, and a second outer pipe diameter at a second location of the tapered dielectric pipe portion, wherein the first outer pipe diameter is larger than the second outer pipe diameter, and wherein the first location is between the hollow tubular dielectric sleeve portion and the second location.

The dielectric pipe may have a dielectric constant ranging from about 1.5 to about 9.

The first conductor may include an upper notch at a distal end away from the double-ridged waveguide section, wherein the second conductor includes a lower notch at a distal end away from the double-ridged waveguide section, and wherein the upper and lower notches are configured to reduce reflection of the wave propagated by the upper conductor and the lower conductor.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
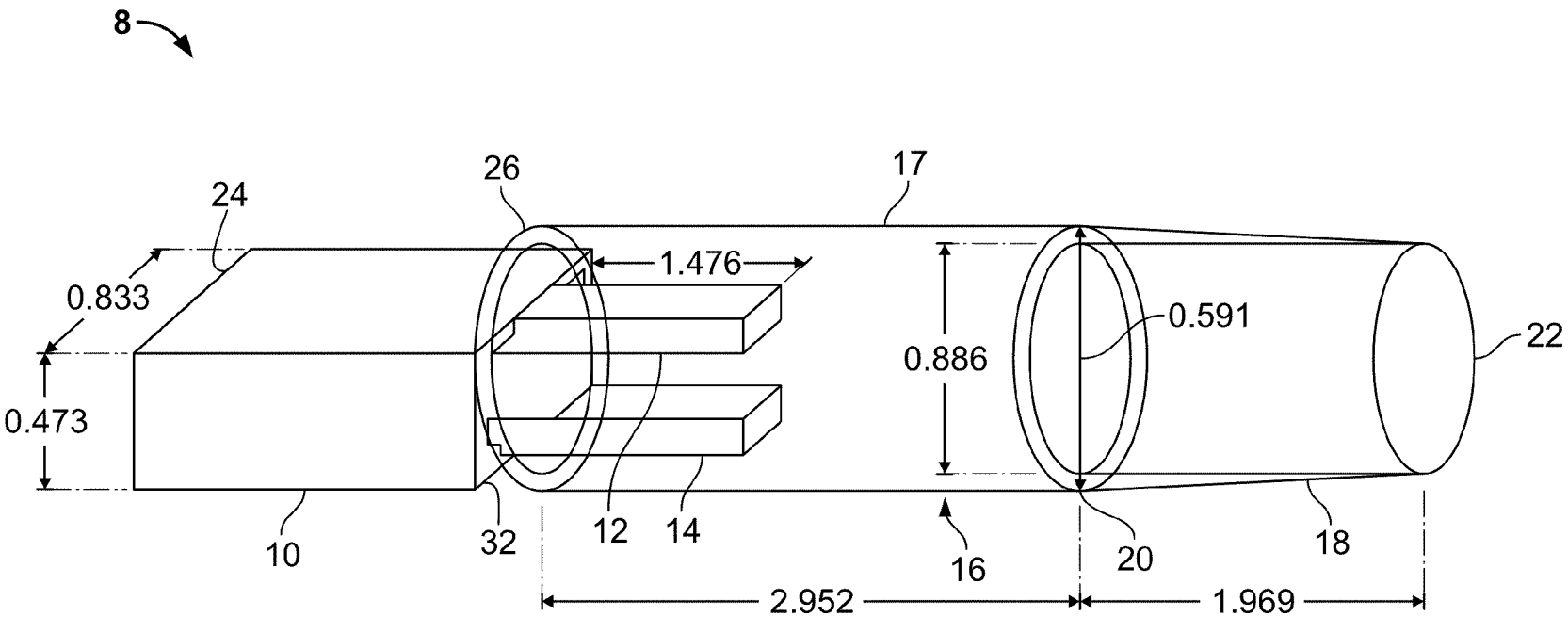
FIG. 1 is a perspective schematic view of an antenna of an embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Unless specifically noted, it is intended that the words and phrases in the specification and the claims be given the ordinary and accustomed meaning to those of ordinary skill in the applicable arts. If any other special meaning is intended for any word or phrase, the specification will clearly state and define the special meaning. In particular, most words have a generic meaning. If it is intended to limit or otherwise narrow the generic meaning, specific descriptive adjectives will be used to do so. Absent the use of special adjectives, it is intended that the terms in this specification and claims be given their broadest possible, generic meaning.

Likewise, the use of the words "function" or "means" in the Description of the Invention is not intended to indicate a desire to invoke the special provisions of 35 U.S.C. 112, Paragraph 6, to define the invention. To the contrary, if it is intended to invoke the provisions of 35 U.S.C. 112, Paragraph 6, to define the inventions, the claims will specifically recite the phrases "means for" or "step for" and a function, without also reciting in such phrases any structure, material or act in support of the function. Even when the claims recite a "means for" or "step for" performing a function, if they also recite any structure, material or acts in support of that means or step, then the intention is not to provoke the provisions of 35 U.S.C. 112, Paragraph 6. Moreover, even if the provisions of 35 U.S.C. 112, Paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

Investigator may need to evaluate small regions of a sample to obtain microwave constitutive properties. Previously, these investigators have resorted to two main approaches. One approach is to create a small aperture on a metal screen (ground plane) through which a electromagnetic field is transmitted from a source on one side to a receiver on the other side. When the sample (typically a thin sheet) is placed over this aperture, the modification in the electromagnetic field is related to properties of the sample.

The difficulty with this approach is that the electromagnetic field at the aperture is not a plane wave, and, thus, the response of the material to a plane wave is not being measured. The presence of reactive fields in the aperture implies that the sample is altering the admittance of the aperture and not simply serving as a transmitting medium. As a result, it is difficult to correlate the measured properties with the constitutive properties of the material. Although it would be possible to compute the electromagnetic interaction with the wave, the aperture, and the material for any given type of material (with a given thickness), the result of that computation would not apply to other materials or thicknesses of materials, given the complexity of reactive field interactions.

An alternative approach is to utilize a system of lenses to focus a signal traveling between a plane wave source and a plane wave receiver (a pair of antennas in each other's far field). Such a focusing system can, in principle, concentrate electromagnetic energy into a spot-size approximately $\lambda/\pi$ in diameter. The difficulty with this approach is that, by definition, the spot-size generated is a strong function of frequency, so that if a spot-size 2 inches by 2 inches is being examined at 3 GHz, the spot-size shrinks to 0.3 inches by 0.3 inches at 20 GHz. Thus, any manufacturing inhomogeneities in the sample become significant sources of noise at high frequencies.

In one embodiment, a further problem is that the speed of light in the focal spot of a focused beam system is not equal to the speed of light in free space, but is actually faster. Furthermore, the radiating field in the neighborhood of the focal spot contains "hotspots", where the amplitude and phase of the electromagnetic beam varies rapidly. All of these factors combine to render the sample measurements at the focal spot different from measurements that would result under plane wave conditions.

Figure 2:
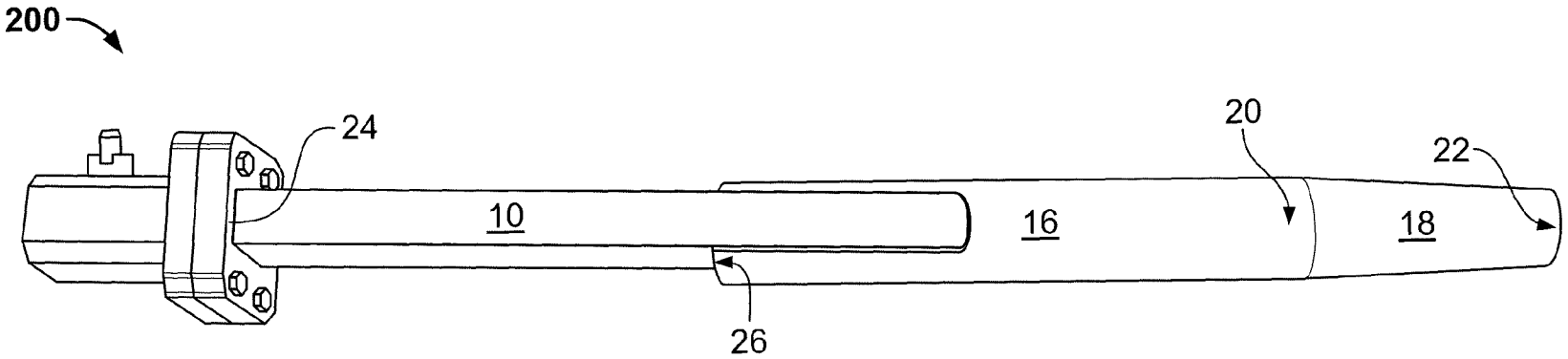
FIG. 2 is an antenna of an embodiment of the present invention.

According to an embodiment of the present invention, as shown in FIGS. 1 and 2, a hollow dielectric pipe 16 is coupled to the extended conductors (or ridges or transmission lines) 12, 14 of a modified double ridge waveguide 10 to form an antenna 8 with a substantially plane wave substantially within a cross section of the dielectric pipe 16. This guided wave may be transmitted into free space by tapering the wall 18 thickness of the dielectric pipe 16 from a cross-section 20 towards a second end 22 of the dielectric pipe 16. Adjacent to the second end 22, the wave has maximum planarity and is substantially confined to a diameter that is substantially similar to the diameter of the dielectric pipe 16. As a result, substantially plane wave conditions are in a region about 0.75 inches in diameter for frequencies that range from about 5.6 GHz to about 16 GHz. The dimensions shown in FIG. 1 are exemplary, and may be modified within the scope of the present invention. However, other suitable materials, and suitable geometries can also be used, and other suitable frequencies can also be achieved.

The plane wave conditions and nearly uniform field distribution in the small region is suited for measuring constitutive properties or the transmission and reflection coefficients of samples of sheet materials, particularly graded impedance cards.

In an embodiment of the present invention, as shown in FIG. 1, the first end 26 of the dielectric pipe 16 is positioned to surround the extended conductors 12, 14. The dielectric pipe 16 may be fixed to the waveguide 10 by any suitable means, such as a pressure fit or an adhesive.

In another embodiment of the present invention, as shown in FIG. 2, slots are formed at the first end 26 of dielectric pipe 16 so that the slots may be positioned about the double ridge waveguide 10. The dielectric pipe 16 may then be fixed to (or inserted by) the waveguide 10 by any suitable means, such as a pressure fit or an adhesive.

Figure 3:
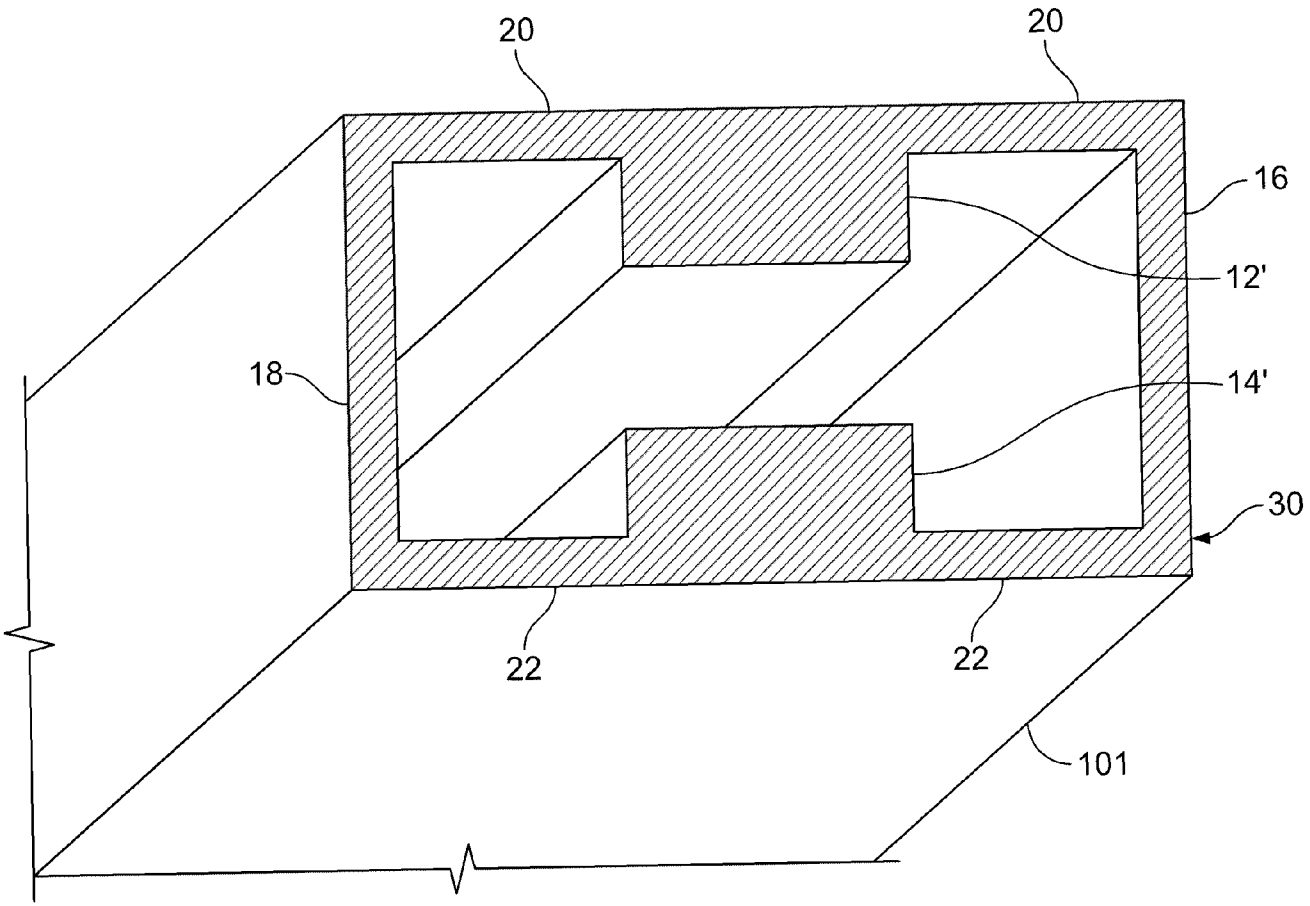
FIG. 3 is a perspective view of a double ridge waveguide.

As shown in FIG. 3, an unmodified double ridge waveguide 101 has an upper ridge 12' and a lower ridge 14'. According to an embodiment of the present invention, the side walls 16, 18, the top wall 20 and the bottom wall 22 are removed from an end 30 along a length of the double ridge waveguide 101 to form the modified double ridge wave guide 10 of FIGS. 1 and 2 with the extended conductors 12, 14.

In another embodiment of the present invention, the extended conductors 12, 14 may be attached by any suitable means, such as welding, to an unmodified double ridge waveguide.

Referring again to FIG. 1, the mouth 32 of the modified double ridge waveguide 10 is an abrupt termination of the walls 16, 18, 20, 22 of the double ridge waveguide 101 of FIG. 3. The extended conductors 12, 14 continue beyond the mouth 32. The resulting capacitive echo (from the termination of the top wall 20 and the bottom wall 22) and inductive echo (from the termination of the side walls 16, 18) substantially cancel each other, thus, making the transition from the double ridge waveguide 10 to a two-conductor transverse electromagnetic (TEM) line formed of the extended conductors 12, 14 well matched.

TEM lines can be effectively coupled to dielectric slab waveguides by placing the TEM line and the dielectric slab in direct contact with each other (see the sununary article by Eric Spitz, "A class of new type of broad-band antennas", in Electromagnetic Theory and Antennas, edited by E. C. Jordan, Pergamon Press, New York, 1963, pp. 1139-1148, expressly incorporated herein by reference in its entirety). The combined structure nominally supports several hybrid modes. As a result, the wave contained entirely in the TEM line at the beginning of the structure may be substantially transferred to the dielectric slab after a coupling length.

The efficiency of the transfer is maximized when the wave on the TEM line and the surface wave on the dielectric waveguide have similar phase velocities. The dielectric pipe is suitable for coupling to the TEM line, because the lowest order linearly polarized mode supported by the dielectric pipe carries most of its energy in the air inside the dielectric pipe. Therefore, the phase velocity of the lower order linearly polarized mode in the dielectric pipe is close to the speed of light in air, as is the phase velocity of the TEM line.

Figure 4:
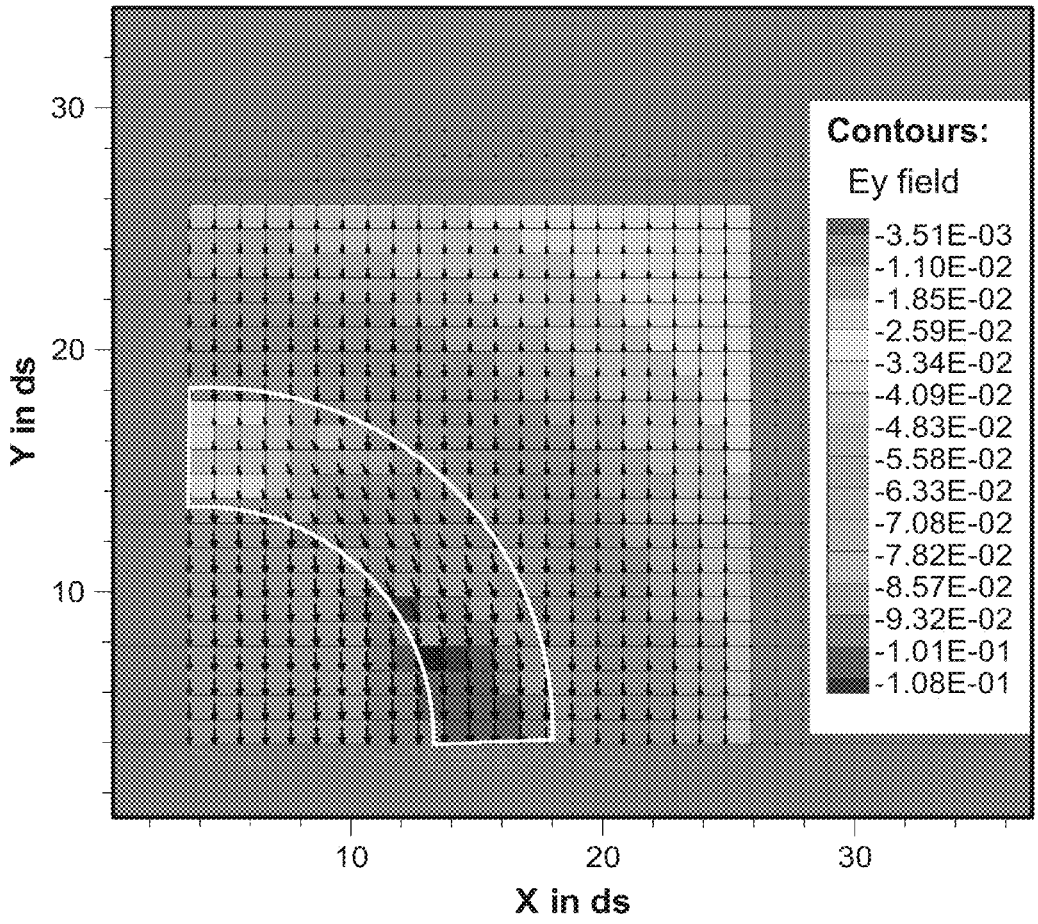
FIGS. 4 and 5 are, respectively, a vector plot of a calculated E-field and associated contours of field strength, and a vector plot of a calculated H-field and associated contours of field strength of an antenna of an embodiment of the present invention.

FIG. 4 shows a vector plot of a calculated E-field inside the dielectric pipe as a broadband pulse propagates within it. The spectrum of the pulse is in a range from about 5.5 GHz to about 18 GHz. Because of symmetry, only one quadrant of the structure is shown. Overlaid on the vector plot are contours of strength of the principal (or dominant) vertically polarized field Ey.

Figure 5:
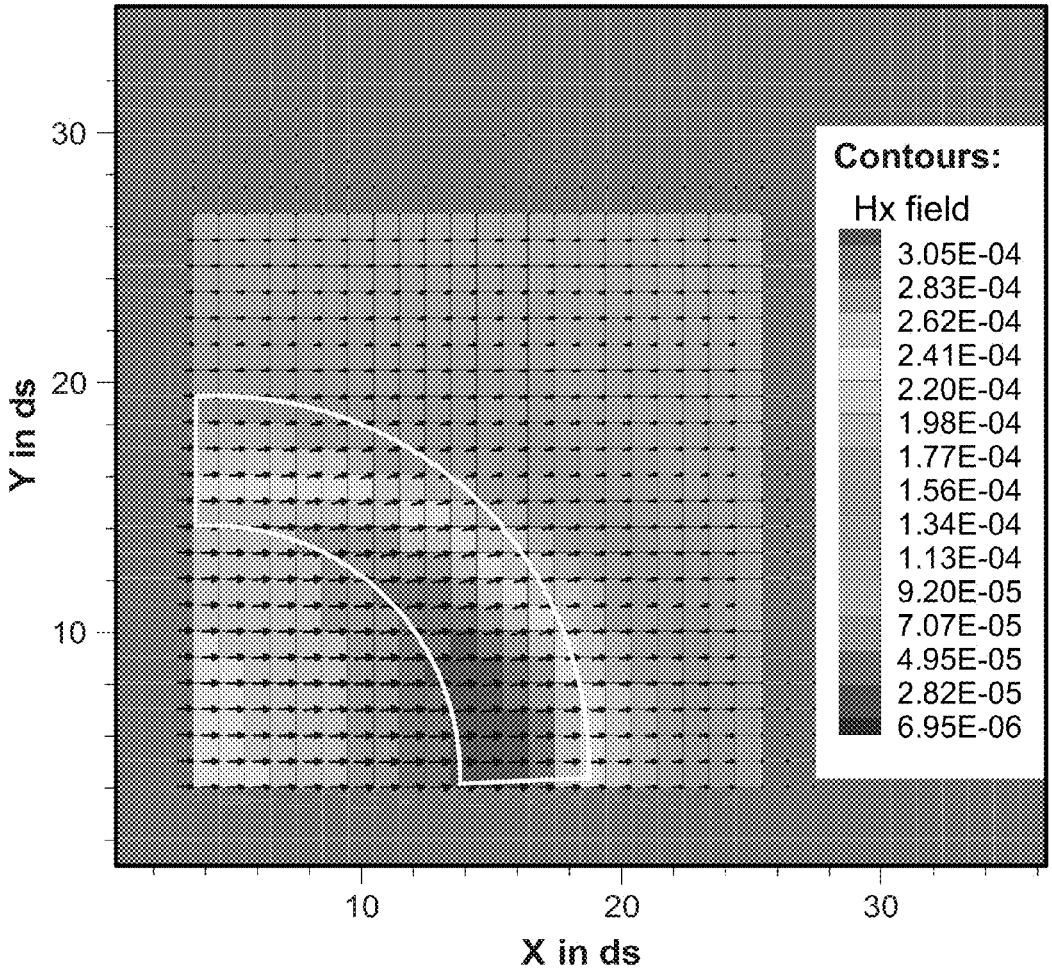

FIG. 5 shows the calculated H-field vector plot and associated contours of field strength of the dominant horizontal magnetic field Hx. The field inside the pipe is dominated by a vertically polarized quasi-plane wave.

Over the operating band of frequencies of an antenna of an embodiment of the present invention, the electromagnetic field is nearly uniform across the horizontal plane and varies by approximately 10% in the vertical plane, exhibiting a maximum at the center of the pipe. Outside the pipe the field decays exponentially, as expected from any guided surface wave.

To maximize (or increase) the amount of energy transferred, extended ridge length should be close to a coupling length. This length can be determined utilizing full wave computational electromagnetic codes. To further optimize (or increase) this transfer, the echo from the ridge termination may be minimized (or reduced).

Figure 6:
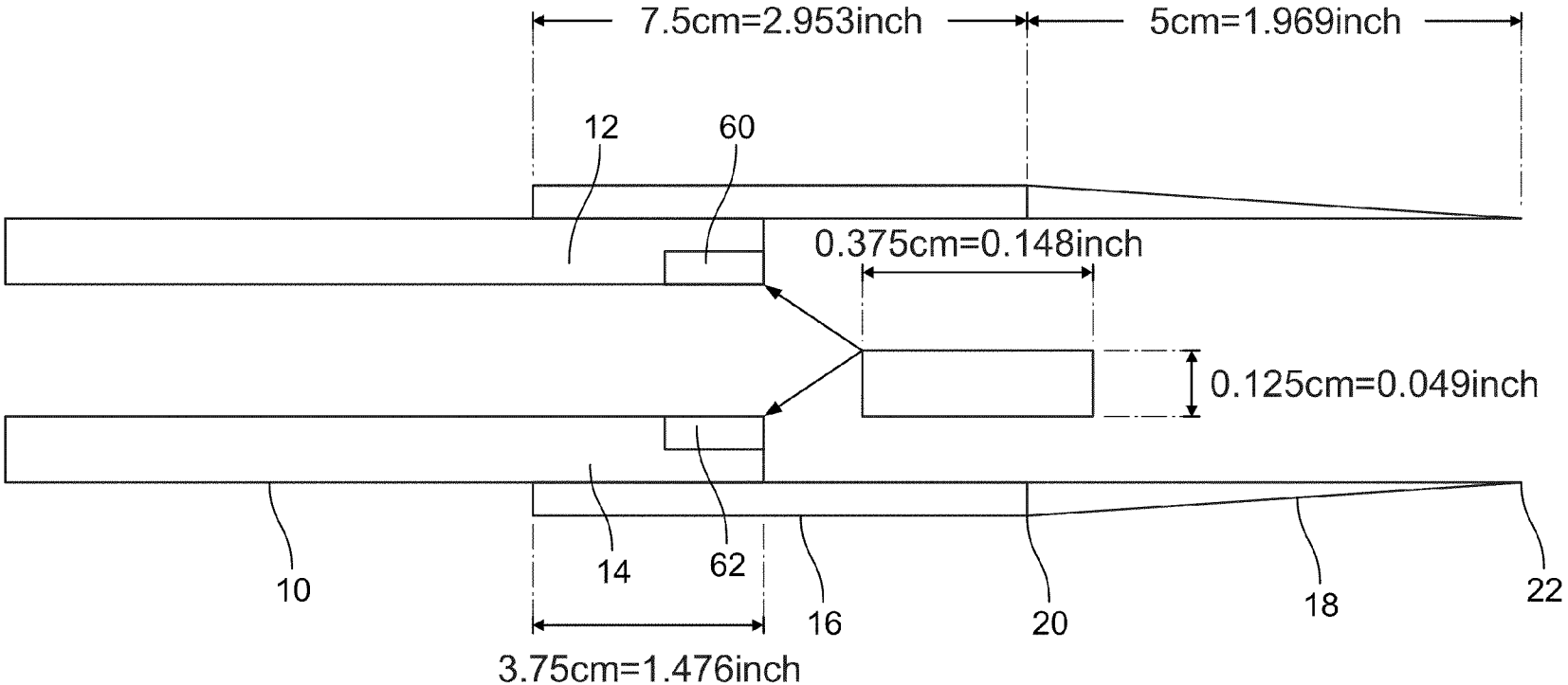
FIG. 6 is a schematic cross-sectional view of an antenna an embodiment of the present invention.

As shown in FIG. 6, this minimization (or reduction of the echo from the ridge termination) may be accomplished by removing a portion (or forming a notch) 60, 62 of the extended conductors 12, 16 towards the dielectric pipe 16 to form destructive interference between the first portion 60 and the second portion 62. Once the double ridge waveguide 10 is coupled to the dielectric pipe 16, the dielectric pipe 16 must be terminated with minimum reflection. Here, reflection is minimized by linearly tapering the wall thickness 18 of the dielectric pipe 16.

Figure 7:
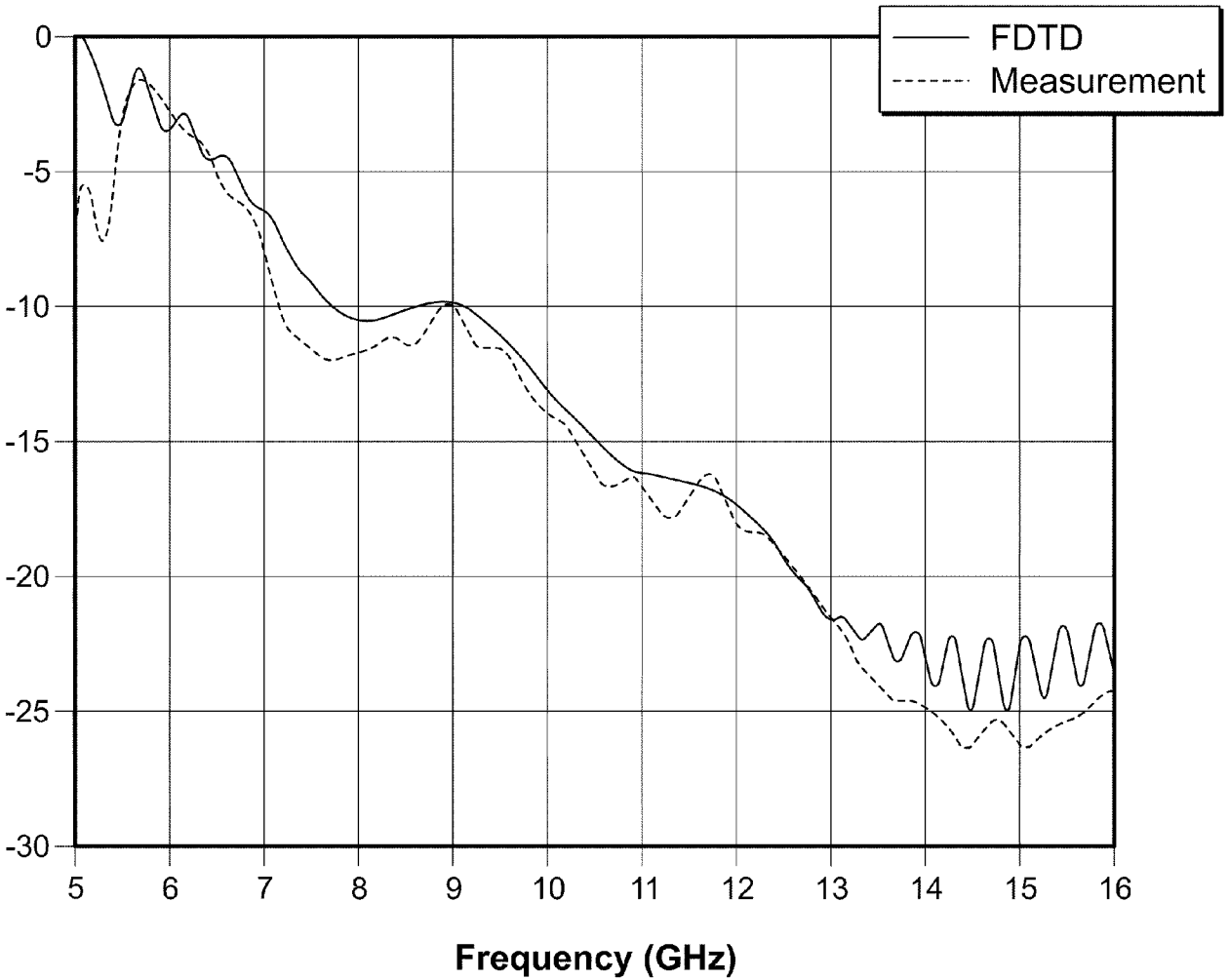
FIG. 7 is a graph of computed and measured reflection coefficients just before the end of an antenna of an embodiment of the present invention.

By minimizing (or reducing) the reflection from the antenna, radiated power is maximized (or increased). FIG. 7 shows the computed and measured reflection coefficient at a plane just before the end of the waveguide for an antenna of an embodiment of the present invention. The measurement was performed utilizing an Agilent 8720 vector network analyzer. A time domain gate was utilized to eliminate the SMA coax to waveguide transition of the waveguide feed from the measurement to measure only the radiating portion of the antenna. (The coax to waveguide transition of commercially available double ridge waveguides typically exhibits a reflection coefficient greater than −10 dB from 6.5 GHz to 16 GHz.) FIG. 7 shows that the antenna radiates at least half the power fed to it at 6 GHz (−3 dB reflection coefficient) and greater than 90% of the power above 7.5 GHz (−10 dB reflection coefficient).

Figure 8:
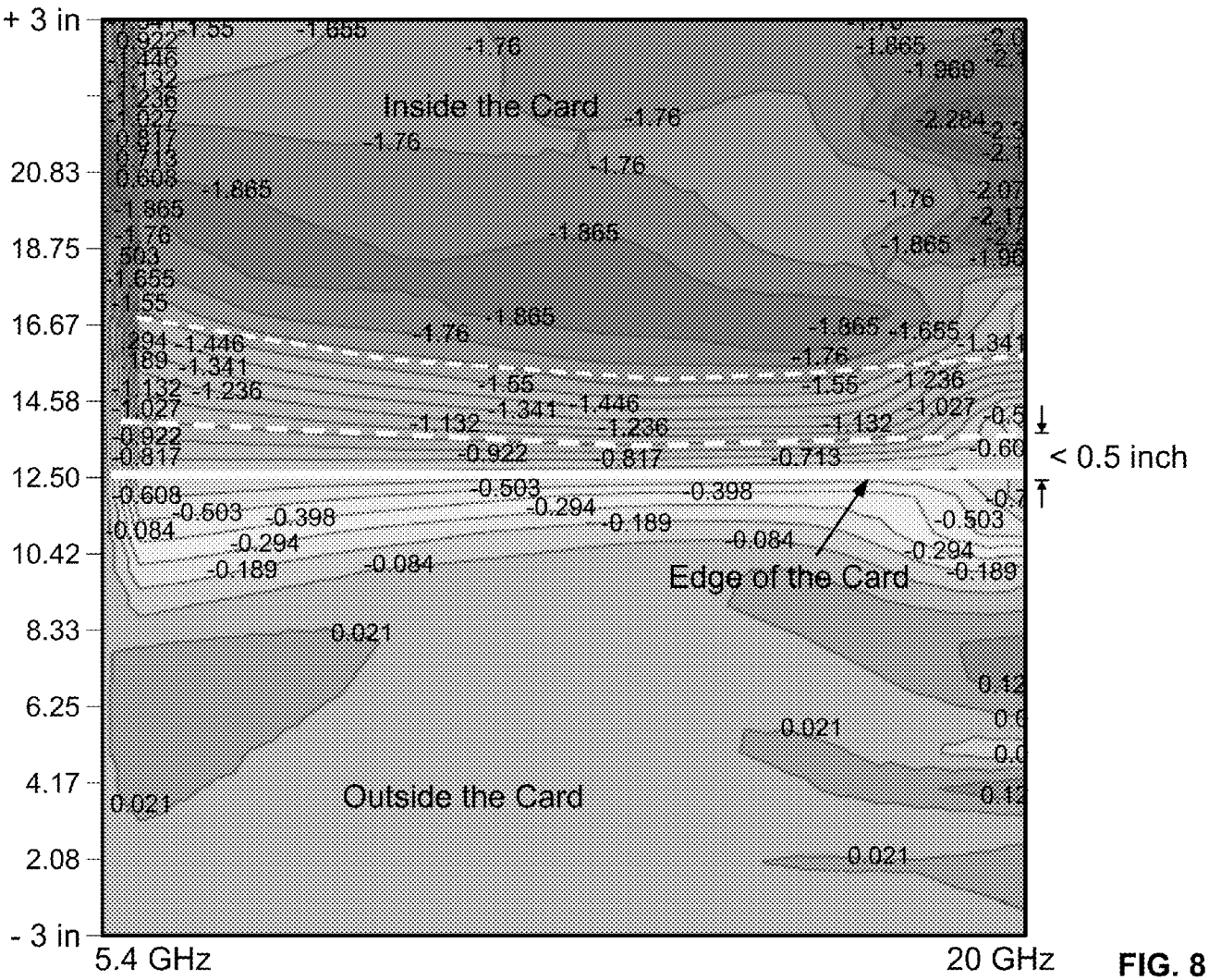
FIG. 8 is a plot of experimentally determined spot-size as a function of frequency 0.5 inches from the end of an antenna of an embodiment of the present invention.

The electromagnetic wave launched from the dielectric pipe provides an suitable quasi-plane wave compact region for examining the properties of samples, e.g. impedance sheets. FIG. 8 shows experimentally determined spot-size as a function of frequency of an antenna of an embodiment of the present invention, as observed 0.5 inches from its end. In the experiment, a pair of aligned antennas were moved across a resistive sheet (R-card) with an insertion loss of about −1.8 dB, so that as the R-card crosses the midplane of the antennas, the R-card interrupts the signal propagating between the antennas.

The measured insertion loss was plotted (y axis) versus the position of the probes relative to the edge of the R-card from 3 inches away (where −3 inches is not interrupting the beam) to 3 inches past the center of the beam (where +3 inches is fully interrupting the beam). The point at which the antennas register half the loss (−0.9 dB) may be used as a gauge of the size and shape of the antenna's spot-size. As in FIG. 8, this 50% error region occurs just as the center of the antennas' beam crosses half an inch into the R-card. This boundary is nearly frequency independent (x axis) from 5.4 GHz through 16 GHz.

An exemplary application is a measurement of resistively loaded sheet goods, where the local value of the sheet conductance (or loss) is assessed as a function of position. A small spot-size and operation over a broadband of frequencies is desirable. The spot-size shown in FIG. 8 is exemplary. For typical samples, 50% of the value is registered within approximately half an inch of the edge of the material and 90% of the value is registered within approximately 1.5 inches, implying a spot-size containing 90% of the energy in the beam in about a 3 inch diameter.

In another embodiment of the present invention, the removal of portions (or the formed notches) 60, 62 from the ridge extension 12, 14, as shown in FIG. 6, may be modified by a series of cuts, following the practice of multi-section transformers, to obtain a wider frequency match. The dielectric constant of a material of a dielectric pipe of the present invention was about 2.9, but other suitable materials with other suitable dielectric constants may be utilized. In another embodiment of the invention, the dielectric constants of the dielectric pipe may range from about 2.5 to about 3.5, but other suitable dielectric constants could also be utilized. The wall thickness and diameter of the dielectric pipe would be adjusted accordingly, as may be determined by one skilled in the art.

Referring back now to FIGS. 1-3, an embodiment of the present invention provides a waveguide that includes: a first section 10 including a first surface facing a flange 200, a second surface oppositely facing away from the first surface, an upper wall 20, and a lower wall 22 facing the upper wall; and a second section 12, 14 extending out from the second surface; wherein the first section 10 includes an upper ridge 12' disposed on the upper wall 20 of the first section 10 and a lower ridge 14' disposed on the lower wall 22 of the first section 10, wherein the second section 12, 14 includes an upper conductor 12 extending out from a top portion of the second surface and a lower conductor 14 extending out from a lower portion of the second surface with a gap between the upper conductor 12 and the lower conductor 14, wherein the upper conductor 12 is electrically connected to the upper ridge 12', wherein the lower conductor 14 is electrically connected to the lower ridge 14', and wherein the upper conductor 12 and the lower conductor 14 are adapted to propagate a wave from the first section and to reduce a discontinuity of the wave propagated at a connection between the first section and the second section.

Referring now back to FIG. 6, the upper conductor 12 may include an upper notch 60 at a distal end away from the second surface, wherein the lower conductor 14 may include a lower notch 62 at a distal end away from the second surface, and wherein the upper and lower notches 60, 62 are configured to reduce reflection of the wave propagated by the upper conductor 12 and the lower conductor 14.

Referring back now to FIGS. 1-3, the second section may consist essentially of the upper conductor 12 extending out from the top portion of the second surface and the lower conductor 14 extending out from the lower portion of the second surface with the gap between the upper conductor 12 and the lower conductor 14.

Referring back now to FIGS. 1-3, an embodiment of the present invention provides a waveguide including: a double-ridged waveguide section 10 having a first ridge 12' and a second ridge 14'; a first conductor 12 extending from the first ridge 12'; and a second conductor 14 extending from the second ridge 14'; wherein the first and second conductors 12, 14 are configured to propagate a wave from the double-ridged waveguide section 10 and to reduce a discontinuity of the wave propagated at a connection between the double-ridged waveguide section 10 and the two conductors 12, 14.

Referring now back to FIGS. 1-3, an embodiment of the present invention provides a dielectric pipe antenna including: a dielectric pipe 16; and a waveguide 10 for receiving one end of the dielectric pipe 16; wherein the waveguide 10 includes: a first section 10 including a first surface facing a flange, a second surface oppositely facing away from the first surface, an upper wall 20, and a lower wall 22 facing the upper wall 20; and a second section 12, 14 extending out from the second surface; wherein the first section 10 includes an upper ridge 12' disposed on the upper wall of the first section 10 and a lower ridge 14' disposed on the lower wall of the first section 10, wherein the second section 12, 14 includes an upper conductor 12 extending out from a top portion of the second surface and a lower conductor 14 extending out from a lower portion of the second surface with a gap between the upper conductor 12 and the lower conductor 14, and wherein the dielectric pipe 16 includes: a hollow tubular dielectric sleeve portion 17 having an external sleeve diameter and an internal sleeve diameter; and a tapered dielectric pipe portion 18 having an internal pipe diameter, a first outer pipe diameter at a first location of the tapered dielectric pipe portion 18, and a second outer pipe diameter at a second location of the tapered dielectric pipe portion 18, wherein the first outer pipe diameter is larger than the second outer pipe diameter, and wherein the first location is between the hollow tubular dielectric sleeve portion 17 and the second location.

Moreover, the dielectric pipe 16 may have a dielectric constant ranging from about 1.5 to about 9, or the dielectric pipe 16 may have a dielectric constant ranging from about 2.5 to about 3.

Additionally, the hollow tubular dielectric sleeve portion 17 may surround and be electromagnetically coupled to the upper conductor and the lower conductor of the second section.

Further, a wave generated within the dielectric pipe 16 may be substantially planar, and wherein a generated wave upon exiting the dielectric pipe 16 may be substantially the same as the wave generated within the dielectric pipe 16 surrounding the upper conductor 12 and the lower conductor 14.

Also, each of the upper conductor 12 and the lower conductor 14 of the second section 12, 14 may have a length configured to maximize an electromagnetic coupling of the upper conductor 12 and the lower conductor 14 to the dielectric pipe 16 surrounding the upper conductor 12 and the lower conductor 14.

The upper conductor 12 may include an upper notch 60 at a distal end away from the second surface, wherein the lower conductor 12 may include a lower notch 62 at a distal end away from the second surface, and wherein the upper and lower notches 60, 62 may be configured to reduce reflection of the wave propagated by the upper conductor 12 and the lower conductor 14.

A height of the first metallic section 10 of the waveguide may be about 0.473 inches, a width of the first metallic section 10 of the waveguide may be about 0.833 inches, and each of the upper conductor 12 and the lower conductor 14 may have a length of about 1.476 inches, and wherein the height of the first metallic section 10, the width of the first metallic section 10, and the length of each of the upper conductor 12 and the lower conductor 14 may be configured to operate at frequency ranging from about 5.5 GHz to about 18 GHz.

A length of the hollow tubular dielectric sleeve 17 may be at about 2.952 inches, the internal sleeve diameter may be about 0.886 inches and a length of the tapered dielectric pipe portion 18 may be at about 1.969 in, and wherein the length of the hollow tubular dielectric sleeve 17, the internal sleeve diameter, and the length of the tapered dielectric pipe portion 18 may be configured to operate at a frequency range of about 5.5 GHz to about 18 GHz.

A length of the hollow tubular dielectric sleeve 17, the internal sleeve diameter, a length of the tapered dielectric pipe portion 18 and proportions of the double-ridged waveguide 10 may be configured to operate at a frequency range of about 100 MHz to about 100 GHz.

The one end of the dielectric pipe 16 may make a releasable-fit engagement with the second metallic section of the waveguide.

In view of the foregoing, an embodiment of the present invention provides a hollow dielectric pipe polyrod antenna capable of providing a relatively small spot-size in a plane wave condition.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A dielectric pipe antenna comprising:

a dielectric pipe; and a waveguide for receiving one end of the dielectric pipe;

wherein the waveguide comprises:

a first section including a first surface facing a flange, a second surface oppositely facing away from the first surface, an upper wall, and a lower wall facing the upper wall; and a second section extending out from the second surface;

wherein the first section comprises an upper ridge disposed on the upper wall of the first section and a lower ridge disposed on the lower wall of the first section, wherein the second section comprises an upper conductor extending out from a top portion of the second surface and a lower conductor extending out from a lower portion of the second surface with a gap between the upper conductor and the lower conductor, and wherein the dielectric pipe comprises:

a hollow tubular dielectric sleeve portion having an external sleeve diameter and an internal sleeve diameter; and a tapered dielectric pipe portion having an internal pipe diameter, a first outer pipe diameter at a first location of the tapered dielectric pipe portion, and a second outer pipe diameter at a second location of the tapered dielectric pipe portion, wherein the first outer pipe diameter is larger than the second outer pipe diameter, and wherein the first location is between the hollow tubular dielectric sleeve portion and the second location.

2. The dielectric pipe antenna of claim 1, wherein the dielectric pipe has a dielectric constant ranging from about 1.5 to about 9.

3. The dielectric pipe antenna of claim 1, wherein the dielectric pipe has a dielectric constant ranging from about 2.5 to about 3.

4. The dielectric pipe antenna of claim 1, wherein the hollow tubular dielectric sleeve portion surrounds and is electromagnetically coupled to the upper conductor and the lower conductor of the second section.

5. The dielectric pipe antenna of claim 1, wherein a wave generated within the dielectric pipe is substantially planar, and wherein a generated wave upon exiting the dielectric pipe is substantially the same as the wave generated within the dielectric pipe surrounding the upper conductor and the lower conductor.

6. The dielectric pipe antenna of claim 1, wherein the second section consists essentially of the upper conductor extending out from the top portion of the second surface and the lower conductor extending out from the lower portion of the second surface with the gap between the upper conductor and the lower conductor.

7. The dielectric pipe antenna of claim 1, wherein each of the upper conductor and the lower conductor of the second section has a length configured to maximize an electromagnetic coupling of the upper conductor and the lower conductor to the dielectric pipe surrounding the upper conductor and the lower conductor.

8. The dielectric pipe antenna of claim 1, wherein the upper conductor comprises an upper notch at a distal end away from the second surface, wherein the lower conductor comprises a lower notch at a distal end away from the second surface, and wherein the upper and lower notches are configured to reduce reflection of the wave propagated by the upper conductor and the lower conductor.

9. The dielectric pipe antenna of claim 1, wherein a height of the first metallic section of the waveguide is about 0.473 inches, a width of the first metallic section of the waveguide is about 0.833 inches, and each of the upper conductor and the lower conductor has a length of about 1.476 inches, and wherein the height of the first metallic section, the width of the first metallic section, and the length of each of the upper conductor and the lower conductor are configured to operate at frequency ranging from about 5.5 GHz to about 18 GHz.

10. The dielectric pipe antenna of claim 1, wherein a length of the hollow tubular dielectric sleeve is at about 2.952 inches, the internal sleeve diameter is about 0.886 inches and a length of the tapered dielectric pipe portion is at about 1.969 inches, and wherein the length of the hollow tubular dielectric sleeve, the internal sleeve diameter, and the length of the tapered dielectric pipe portion are configured to operate at a frequency range of about 5.5 GHz to about 18 GHz.

11. The dielectric pipe antenna of claim 1, wherein a length of the hollow tubular dielectric sleeve, the internal sleeve diameter, a length of the tapered dielectric pipe portion and proportions of the double-ridged waveguide are configured to operate at a frequency range of about 100 MHz to about 100 GHz.

12. The dielectric pipe antenna of claim 1, wherein the one end of the dielectric pipe makes a releasable-fit engagement with the second metallic section of the waveguide.

13. A dielectric pipe antenna comprising:

a dielectric pipe; and a waveguide for receiving one end of the dielectric pipe;

wherein the waveguide comprises:

a double-ridged waveguide section having a first ridge and a second ridge;

a first conductor extending from the first ridge; and a second conductor extending from the second ridge;

wherein the dielectric pipe comprises:

a hollow tubular dielectric sleeve portion having an external sleeve diameter and an internal sleeve diameter; and a tapered dielectric pipe portion having an internal pipe diameter, a first outer pipe diameter at a first location of the tapered dielectric pipe portion, and a second outer pipe diameter at a second location of the tapered dielectric pipe portion, wherein the first outer pipe diameter is larger than the second outer pipe diameter, and wherein the first location is between the hollow tubular dielectric sleeve portion and the second location.

14. The dielectric pipe antenna of claim 13, wherein the dielectric pipe has a dielectric constant ranging from about 1.5 to about 9.

15. The dielectric pipe antenna of claim 14, wherein the first conductor comprises an upper notch at a distal end away from the double-ridged waveguide section, wherein the second conductor comprises a lower notch at a distal end away from the double-ridged waveguide section, and wherein the upper and lower notches are configured to reduce reflection of the wave propagated by the upper conductor and the lower conductor.

* * * * *